US005355848A

United States Patent [19]

Denton

[11] Patent Number: 5,355,848

[45] Date of Patent: Oct. 18, 1994

[54] INTERNAL-COMBUSTION ENGINE WITH CONCENTRIC, ANNULAR INTAKE AND EXHAUST VALVES

[76] Inventor: Richard J. Denton, 11701 Fernshire Rd., Gaithersburg, Md. 20878-1927

[21] Appl. No.: 140,639

[22] Filed: Oct. 25, 1993

[51] Int. Cl.[5] ..... F01L 1/28

[52] U.S. Cl. ..... 123/79 C

[58] Field of Search ..... 123/79 C, 188.2

[56] References Cited

U.S. PATENT DOCUMENTS 1,314,907 9/1919 Shaw ..... 123/79 C 2,756,732 7/1956 Olson ..... 123/79 C

*Primary Examiner*—Noah P. Kamen

[57] ABSTRACT

An internal-combustion-engine cylinder head has a concentric, annular passages to admit an intake charge into a combustion chamber and to remove combustion product exhaust gasses. Each of these passages is isolated from the combustion chamber by the closure of concentric ring valves coaxial with the engine cylinder. Mechanical devices are provided to actuate the valves according to the timing of an engine camshaft. The actuating mechanisms comprise multiple valve stems, concentric operating plates, fork-shaped actuators, and connecting devices.

14 Claims, 8 Drawing Sheets

INTERNAL-COMBUSTION ENGINE WITH CONCENTRIC, ANNULAR INTAKE AND EXHAUST VALVES

BACKGROUND

1. Field of the Invention

This invention relates to intake and/or exhaust valves for reciprocating internal-combustion engines, specifically:

(1) structures within a cylinder head that provide passages for delivering an air-fuel mixture to a combustion chamber and for removing combustion-product exhaust gasses:

(2) a configuration of valves that control the flow of the air-fuel mixture into and the combustion products out of the combustion chamber; and (3) the mechanisms to operate the valves.

2. Prior Art

Reciprocating spark-ignition and compression-ignition internal combustion engines have generally used poppet valves for fuel and/or air intake and combustion product exhaust as appropriate. All four-stroke. spark-ignition engines currently in production use poppet valves. An engine's efficiency or power output can be increased if the area of its valves can be maximized. To increase valve area, many manufacturers are currently making multiple-valve engines, some very complex examples having as many as eight valves per cylinder.

Circular poppet valves have inherent geometric limitations. Poppet valves cannot use all of the available area of a cylinder head. No matter how many small, circular poppet valves are used, there will always be unused areas among the valves, the cylinder edges, and the spark plug or fuel injector. Engines with total valve area substantially smaller than available cylinder head area are inherently inefficient. The valve openings are constrictions to the flow of fuel-air mixtures and exhaust gasses. The engine must perform unproductive work to move these gasses across the constriction. These are commonly referred to as pumping losses. In addition, there is a pressure drop across the valve constrictions while the fuel-air mixture is flowing into the cylinder. This pressure drop limits the amount of fuel-air mixture that can enter the cylinder unless expensive, complex supercharging is used.

Finally, poppet valves are inherently asymmetrical to the cylinder axis. The fuel-air mixture is not uniformly distributed within the cylinder or around the spark plug that initiates combustion. Poppet valves can contribute to incomplete combustion with attendant loss of engine efficiency and increased unburned hydrocarbons in the exhaust stream.

OBJECTS AND ADVANTAGES OF THE INVENTION

This invention proposes a circular, concentric arrangement for engine valves and ports that can use all available cylinder head area for intake and exhaust. The concentric engine valve arrangement provides even and symmetrical distribution of the intake mixture and improved scavenging of exhaust products. Accordingly, objects and advantages of my invention are:

(1) to overcome the inherent geometric limitations of poppet valves;

(2) to reduce the pressure drop across engine intake and exhaust valves as compared to poppet valves;

(3) to reduce the amount of unproductive work that an engine must perform by pumping intake mixtures and exhaust gasses;

(4) to enhance even, symmetrical distribution of the intake fuel-air mixture to promote complete combustion;

(5) to promote complete scavenging of combustion products from the engine cylinder; and (6) to increase engine efficiency and reduce the generation of pollutants by reducing pumping losses and ensuring complete, even combustion.

BRIEF DESCRIPTION OF THE DRAWING FIGURES

The drawings are informal and are not necessarily to scale. Exact dimensions and configuration will vary according to engine application. Closely related drawings have the same figure number but different suffixes. Parts numbers are consistent throughout the drawings and are described and referred to in subsequent sections of this application.

FIG. 1 is a cross-sectional view of a four-cycle spark-ignition engine using the concentric valve arrangement according to the invention.

FIGS. 2(A) through 2(D) are shaded perspective views showing the operation of the concentric intake and exhaust valves during the four stroke cycles of the engine.

Figure 10A:
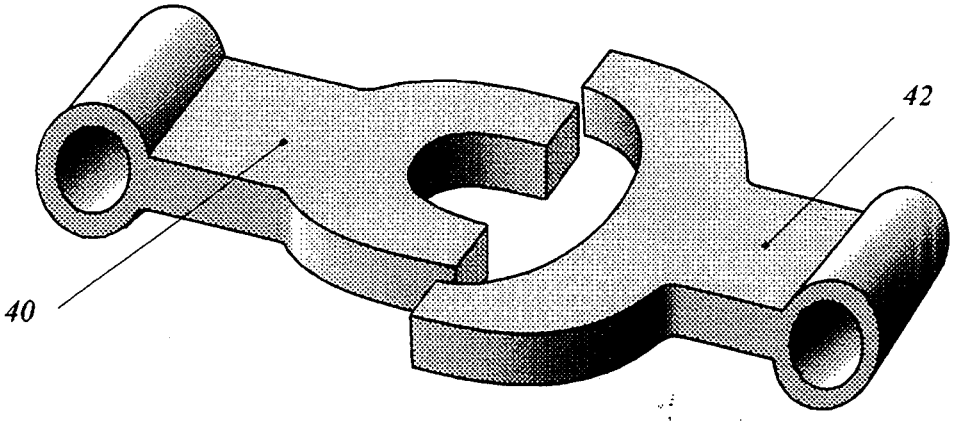
Figure 10B:
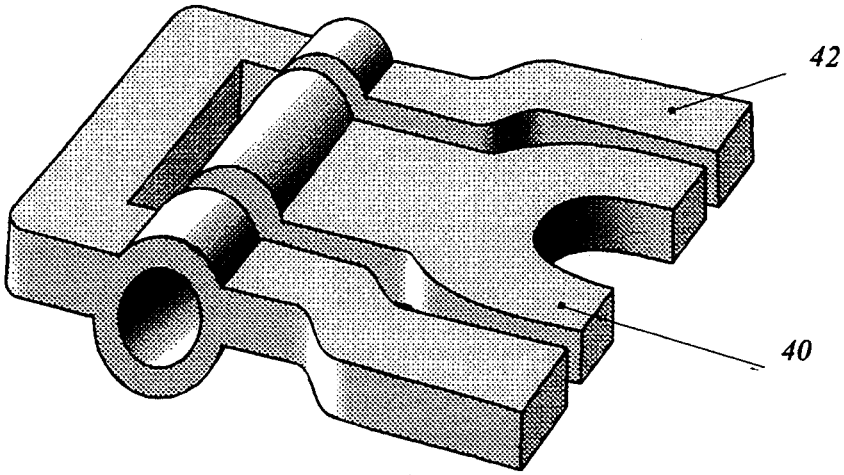
Figure 10C:
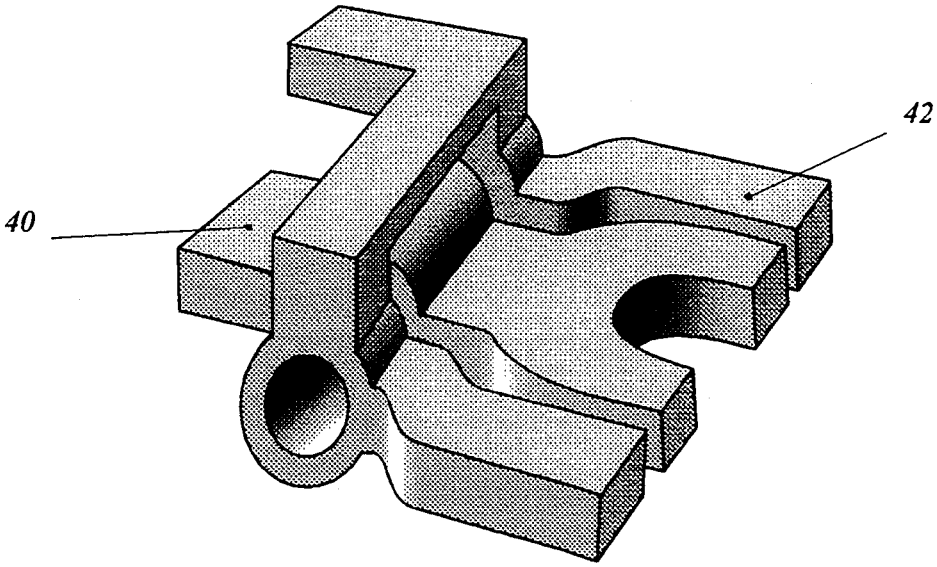

FIGS. 10(A) through 10(C) are perspective drawings of alternative configurations of the opening forks.

Figure 1:
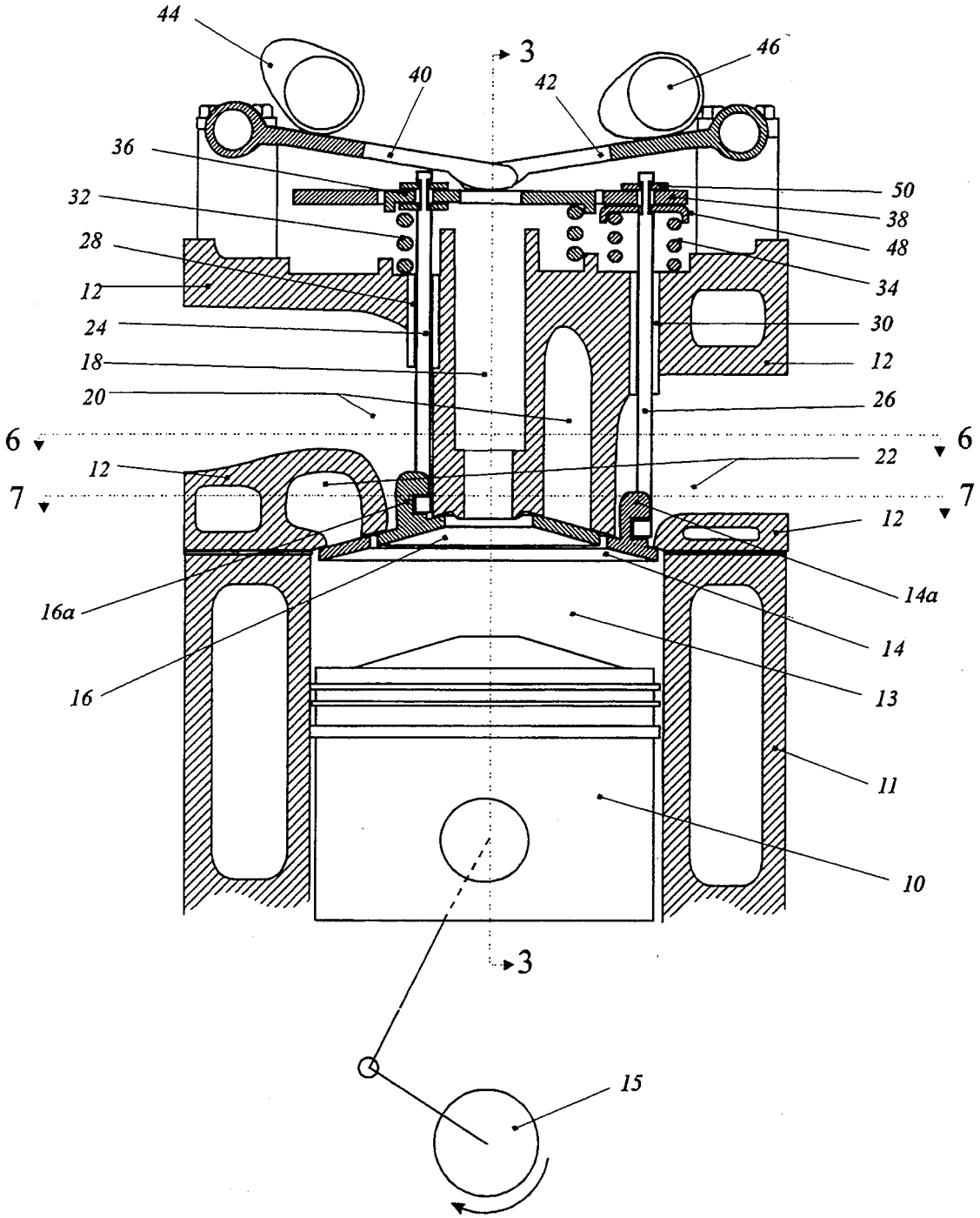

FIGS. 11(A) through 11(D) repeat the view of FIG. 1 and show the position of all parts during each of the four strokes of a four-cycle engine.

DETAILED DESCRIPTION OF THE INVENTION

The drawings and the following discussion concern a typical internal combustion engine using concentric ring valves; concentric, annular intake and exhaust passages; and operating hardware according to the invention. There is no discussion of cooling and lubrication, which are within the skill of the art. Similarly, there is no discussion of minor fasteners, brackets, stiffeners, braces, and gussets that might be applied by the engine designer. The selection of materials and manufacturing processes needed to produce the invention are conventional in nature and are not discussed here. The cylinder block 11 and crankshaft structure 15 (shown schematically) are generally conventional.

The invention relates to an improved internal combustion engine having a cylinder head defining annular intake and exhaust ports and to which are mounted concentric intake and exhaust ring valves; and the hardware necessary to actuate the valves. A typical embodiment of the invention is shown in FIG. 1 which represents a single cylinder of a spark-ignition, four-stroke internal combustion engine with double overhead camshafts. The configuration shown in this and subsequent figures do not represent the only possible configuration or even the preferred choice. Details of the configuration of the invention will vary according to the overall arrangement of the engine to which the invention is being applied. Conventional engine materials and manufacturing methods can be used to produce the invention.

Each ring valve (14, 16) is a circular disk with a hole in its center. The ring valves are not flat but are shaped to match the surface of a truncated cone as shown in FIG. 1. The seat contact surfaces of the ring valve disks are on the convex side and meet the seating surfaces of the cylinder head (12). The ring valves are coaxial with the engine cylinder and each other. The intake ring valve (16) has a hole in its center to accommodate a spark plug (18) in a spark-ignition engine and a fuel injector in a compression-ignition engine, received in a passage 18 open at one end to the outer surface of the engine and having a port in communication with the combustion chamber 13 at its opposite end. The exhaust valve (14), also ring-shaped, is located on the outside perimeter of the intake valve. The surface area of the intake and exhaust valve openings is generally equal, but can be varied widely according to the needs of the engine designer. The conical shape of the ring valves makes them generally self-centering with the cylinder axis even with variations in size due to thermal expansion and contraction. The conical shape also slightly increases the effective area of the cylinder head. The seat contact surfaces for each ring valve disk are located on its upper surface at both the inner and outer perimeters.

Figure 2A:
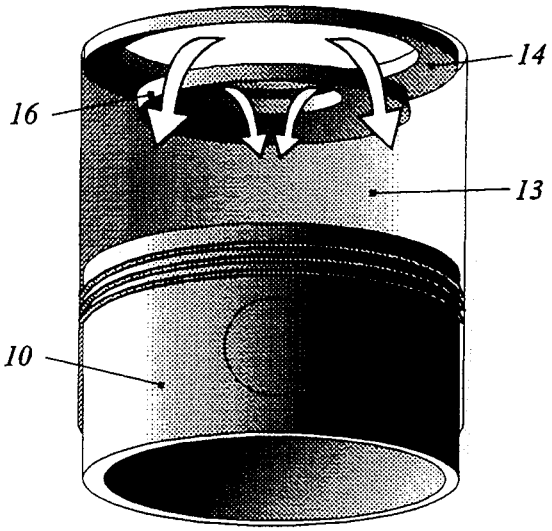
Figure 2B:
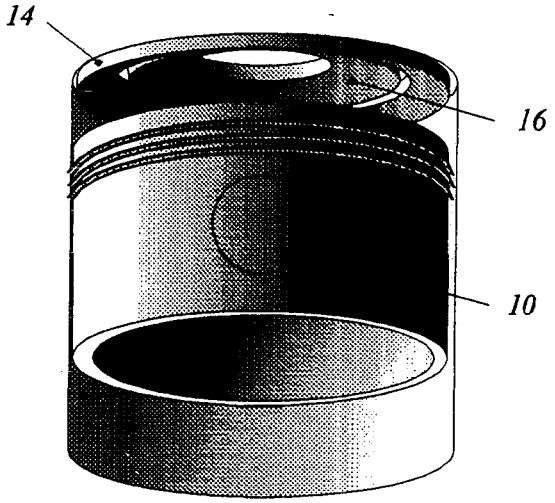
Figure 2C:
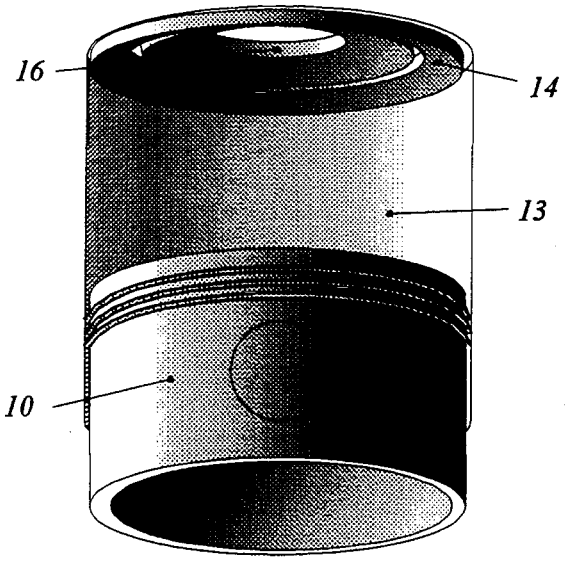
Figure 2D:
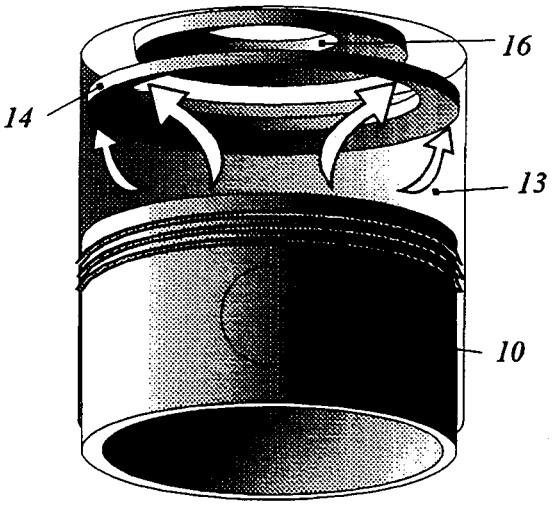

As shown in FIG. 2(A), the intake ring valve (16) is opened downward during the intake stroke of the engine. The fuel-air mixture enters the combustion chamber (13) through the hole in the center of the valve as well as around its periphery. Thus, the intake charge is evenly and symmetrically distributed in the combustion chamber. During the compression and expansion strokes (FIGS. 2(B) and 2(C) respectively) the valves are closed. The exhaust valve (14) is opened downward during the exhaust stroke (FIG. 2(D)) and combustion products are scavenged from all areas of the combustion chamber.

Figure 3:
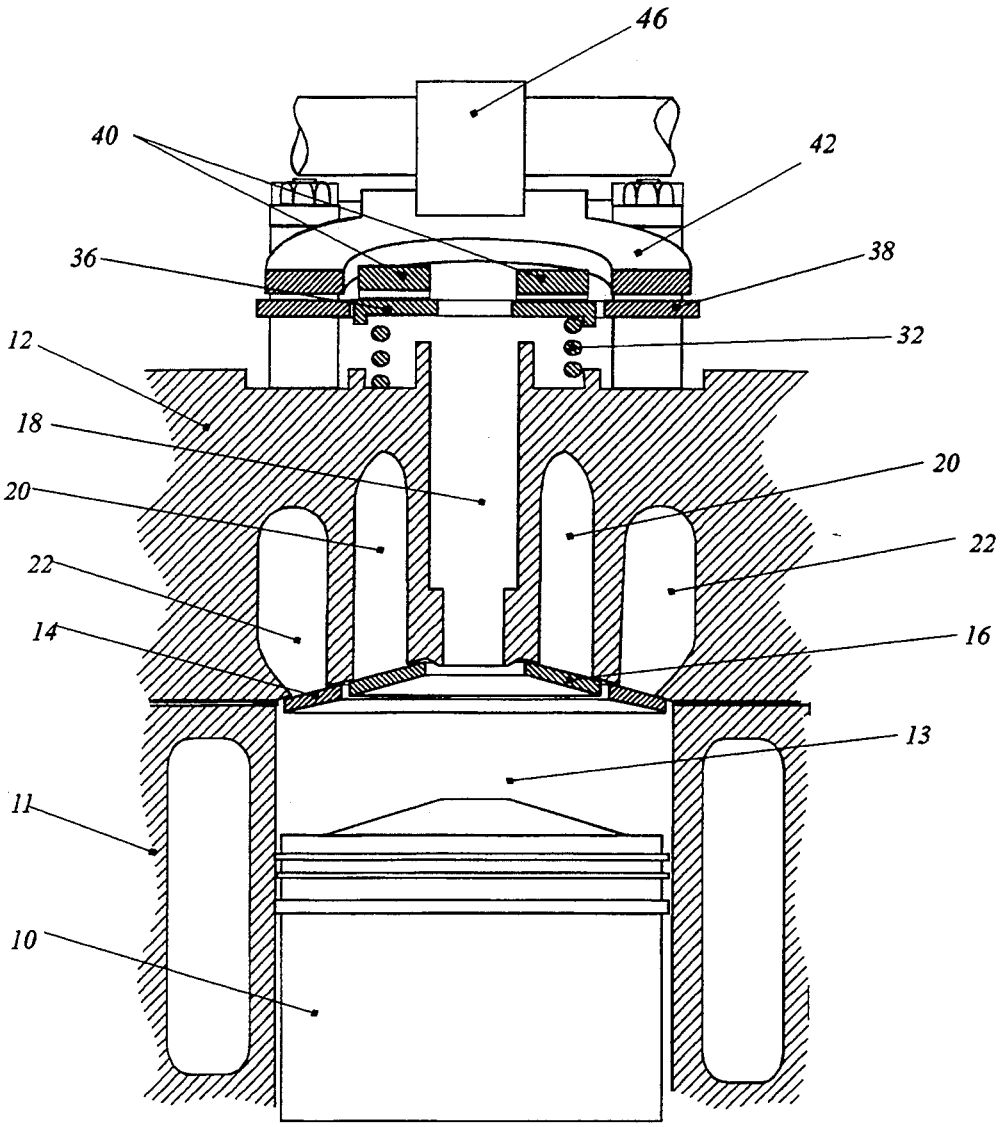
FIG. 3 is a cross-sectional view of the engine taken on line 3—3 of on the vertical axis FIG. 1 on the vertical axis, and shows the configuration of the annular, concentric intake and exhaust ports.

Ports (20, 22) that allow the intake charge to reach the combustion chamber and remove exhaust gasses are also concentric with the cylinder axis and generally annular in configuration. The cross-sectional area of the ports is generally constant, thus there is no constriction to gas flow at the valves. FIG. 3, perpendicular on the vertical axis to FIG. 1, shows how the intake port is annular and concentric to the spark plug and the exhaust port annulus surrounds them both.

Figure 4:
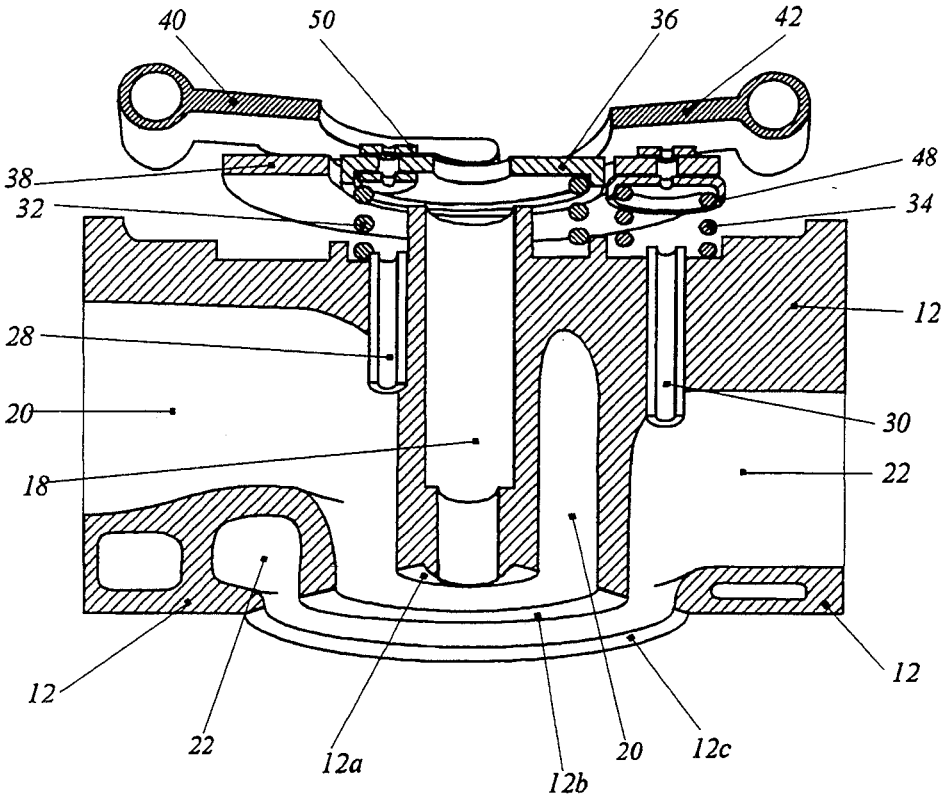
FIG. 4 is a cross-sectional view similar to FIG. 1 except that the engine block, valves, and stems have been removed and the view is tilted slightly away from the viewer to help show the annular ports and the valve seating surfaces.
Figure 6A:
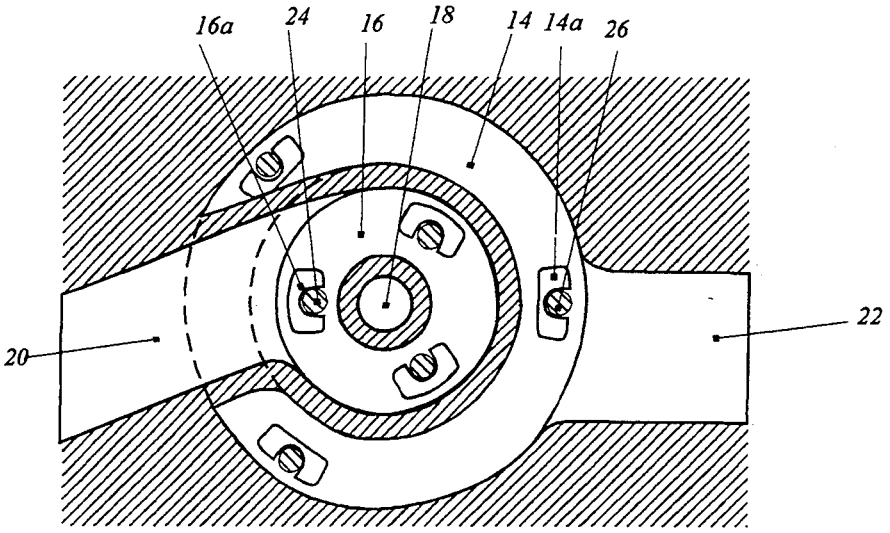
FIG. 6(A) is a cross-sectional plan view on line 6—6 of FIG. 1, and shows the intake and exhaust ports and the top of the valves.
Figure 6B:
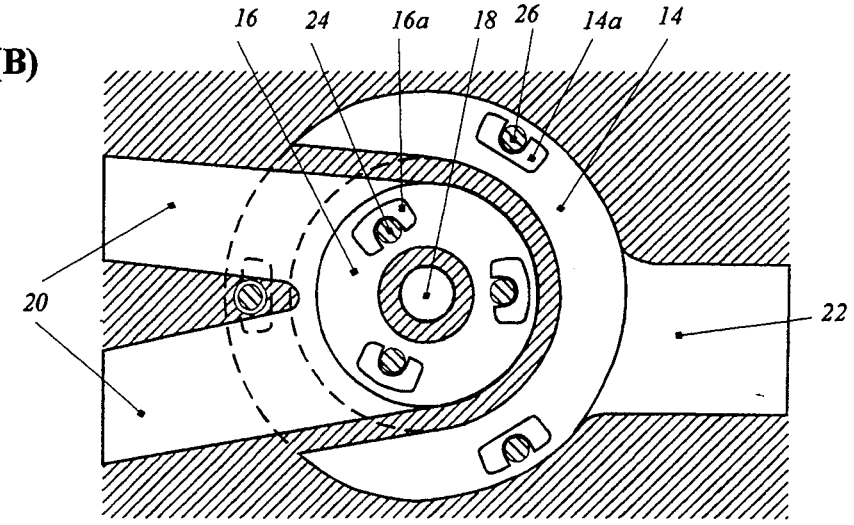
FIG. 6(B) is an alternate configuration that accommodates the use of multiple intake ports.
Figure 7:
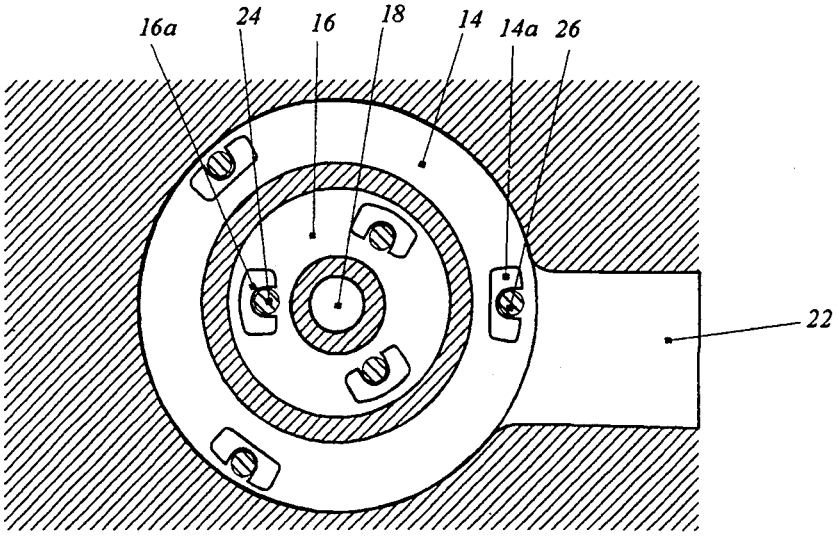
FIG. 7 is a cross-sectional plan view on line 7—7 of FIG. 1, immediately above the valves and shows the annular configuration of the intake and exhaust ports.

FIG. 4 further demonstrates the configuration of the annular intake (20) and exhaust (22) ports. The figure shows the cut-away of the cylinder head (12) from FIG. 1. The valves (14,16) and their stems (24,26) are removed for clarity. The drawing is tilted away from the viewer slightly. This view exposes the seating surfaces on the head (12). An inner seating surface (**12*a*) is used exclusively by the intake valve. An outer seating surface (12*c*) is used exclusively by the exhaust valve. A common seating surface (12*b*) is shared by both valves. FIG. 4 also shows how the exhaust port (22) passes under the intake port (20) on one side of the engine so that there is complete coverage of the periphery of the cylinder. FIG. 6(A) further illustrates the annular configuration of the ports and shows how part of the exhaust port (22) must pass under the intake port (20). The alternate design shown in FIG. 6(B) demonstrates how the intake port (20) can be configured to accommodate dual intake ports. This allows the use of high-speed and low-speed intake runners, a contemporary practice for multi-valve engines. FIG. 7 shows the entire exhaust port (22**).

If necessary for structural rigidity, braces may be placed within the annular port passages. These braces, if used, would be shaped and oriented to control the flow of the intake fuel-air mixture, imparting a spin on the intake charge to further enhance mixing and distribution within the combustion chamber. For clarity, braces are not shown in the drawings.

As shown in FIGS. 6 and 7, the intake valve is typically actuated by three valve stems (24), and the exhaust valve is similarly actuated by three stems (26). Except for their length, the intake and exhaust stems are nearly identical. Each valve stem is fitted into an engagement block (**14*a*, 16*a*) that is integral with the upper surface of the ring valve (14, 16). See FIG. 5**.

Figure 5:
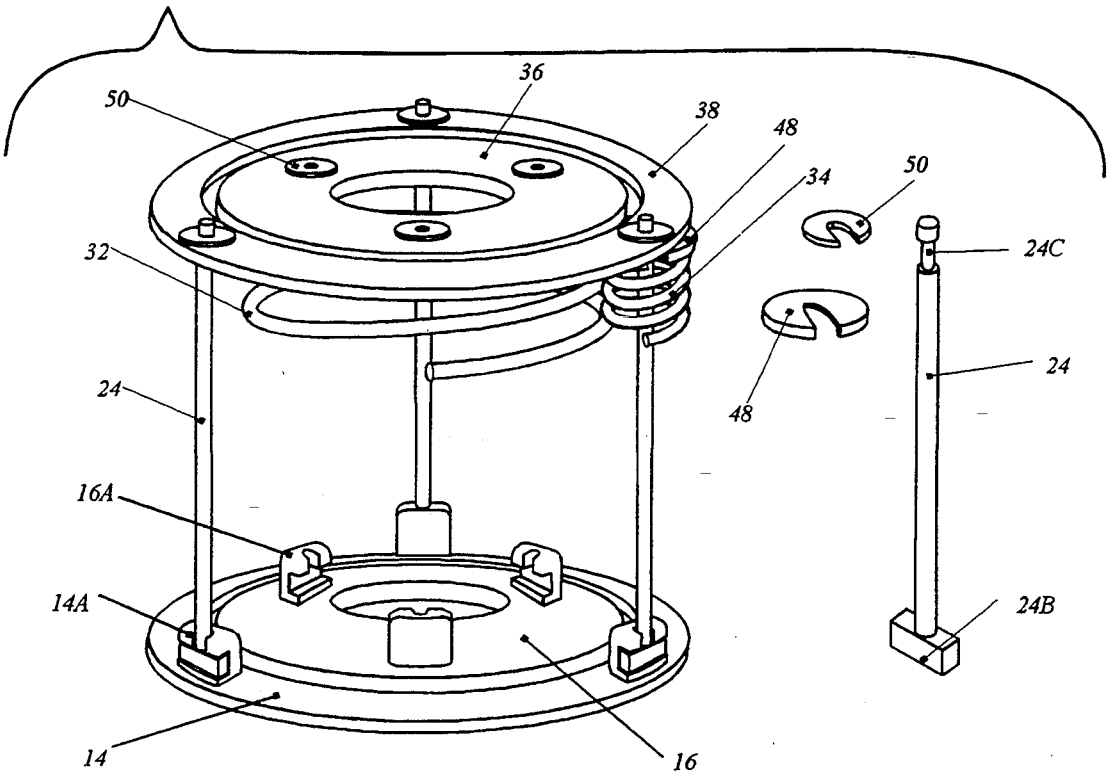
FIG. 5 is a perspective view of the partially assembled valves, stems, operating plates, springs and various fittings.

FIG. 5 is a perspective view showing the valves (14, 16), the exhaust valve stems (24), the intake and exhaust valve operating plates (36 and 38, respectively), exhaust and intake valve closing springs (32 and 34, respectively), and various other hardware. Each ring valve is fitted with multiple valve stems (24), sliding axially within a like number of intake valve stem guides (28) and exhaust valve stem guides (30). In the example shown there are three stems for each valve. The stems are not rigidly attached to the ring valves. Instead, crossbars e.g., 24B on the lower ends of the stems 24 are loosely fitted into the engagement blocks (**14*a*, 16*a*). The perpendicular grooves in the engagement blocks are made slightly larger that the valve stems and crossbars, thus permitting the ring valves to have some freedom for lateral movement relative to the stems. This permits self centering and allows for thermal changes to prevent the stems from binding in the valve guides (28, 30**).

Figure 8A:
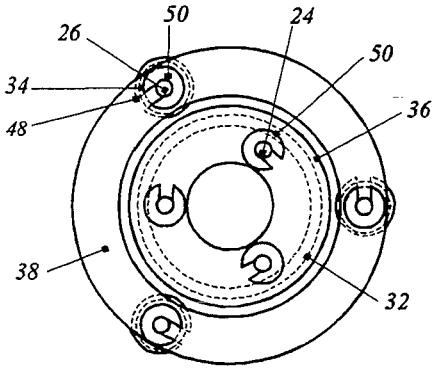
FIG. 8(A) is a plan view with the cams and intake and exhaust valve operating forks removed, showing the valve operating plates and a method for connecting the valve stems and springs where the exhaust stems and springs are coaxial.
Figure 8B:
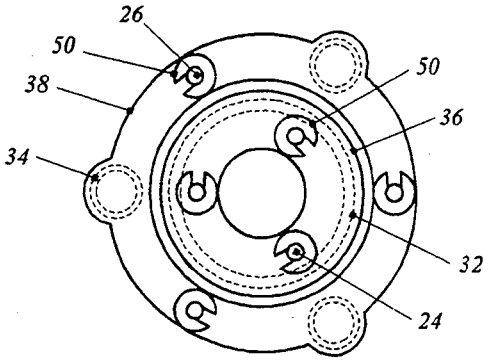
FIG. 8(B) is a similar view of an alternate embodiment where the exhaust stems and springs are not coaxial.

The valve stems are connected at their upper ends to operating plates, one for the intake valve (36) and one for the exhaust valve (38). Each operating plate is a flat disk with a hole in its center. In the application shown, the intake operating plate fits within the central hole in the exhaust operating plate. The central hole in the intake operating plate (36) provides access to the cylinder head for a spark plug for spark-ignition engines. This channel would be used for a centrally located fuel injector for compression-ignition engines. The operating plates are supported by compressed helical springs (32, 34). The operating springs (32, 34) bias the operating plates 36, 38), the valve stems (24, 26), and the valves (14,16) toward the raised (valve shut) position. In the arrangement shown in the figures, there are three small operating springs (34) for the exhaust valve and a single, larger operating spring (32) for the intake valve. In the arrangement shown, the valve stems are connected to the operating plates by spring locators (48) and valve stem keepers (50) that fit into grooves (24*c*) at the end of the valve stems. The spring locators (48) are below the operating plate (36, 38) and prevent the springs from moving laterally. The spring locators also transmit downward motion of the operating plate to the valve stem. The valve stem keepers ((50) are above the operating plate. The valve stem keepers (50) thus also transmit spring bias to the valve stems (24, 26). The locators and keepers may be held in place by a variety of methods, including pins or set screws (not shown). FIGS. 8(A) and 8(B) are plan views of the operating plates (36, 38) showing with alternate possible relationships of the plates, the stems, the connecting hardware, and the operating springs.

Figure 9A:
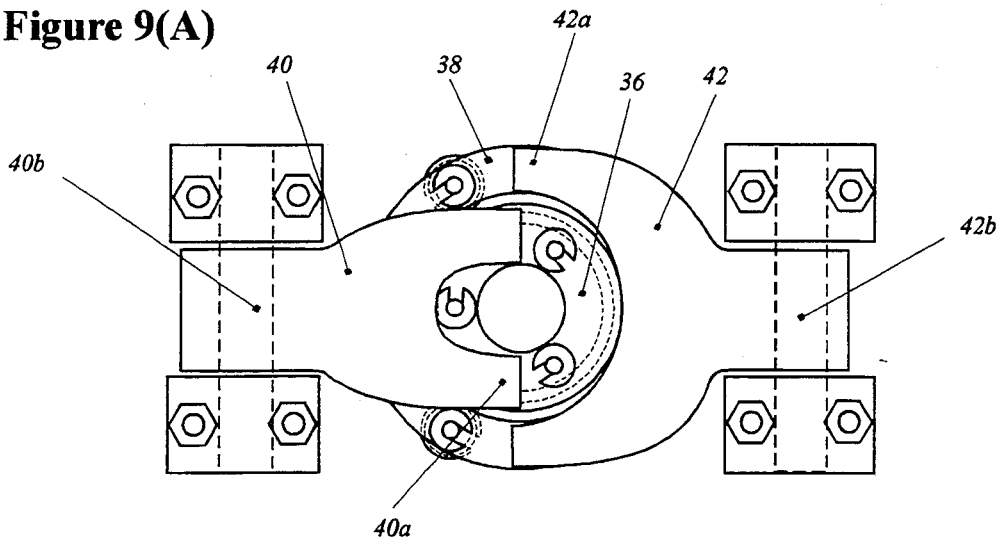
FIG. 9(A) is a plan view with the cams removed and shows the configuration of the intake and exhaust valve operating forks that act as cam followers, and their relation to the valve operating plates.
Figure 9B:
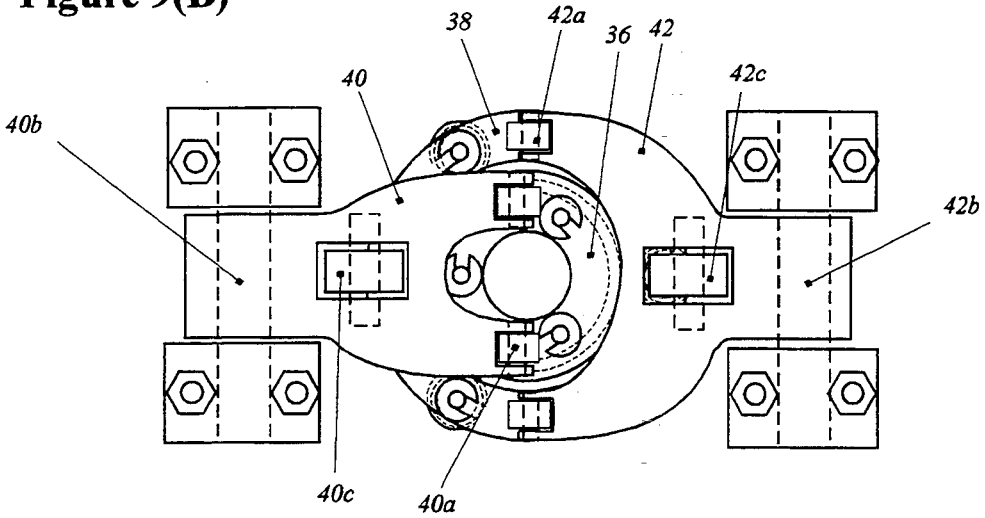
FIG. 9(B) is a similar view of a low-friction alternate configuration that uses rollers on the operating forks to contact the cam lobes and valve operating plates.

As shown in FIG. 1, the operating plates, the springs, and the upper ends of the stems are located atop the cylinder head (12) and are out of the intake and exhaust streams. Valve guides (28, 30) seal the valve stems (24, 26). Each operating plate (40, 42) is moved in the downward (valve open) direction, increasing the compression of the springs, by a valve operating fork (40, 42), so named because of its shape as shown in FIGS. 9(A) and 9(B). The intake fork (40) moves the intake operating plate (36) and an exhaust fork (42) moves the exhaust operating plate (38). The forks translate the rotary motion of the camshafts (44, 46) to the reciprocating motion of the operating plates and the valves. In the application illustrated, each fork moves about a shaft (40*b* and 42*b*, respectively) providing a fulcrum point at the end of the fork. The opposite end of each fork (40, 42) is split into two tines, each of which contacts the fork's respective operating plate (36, 38). FIG. 9(B) shows an alternate configuration where the operating forks are fitted with rollers (40 and 40*c*, and 42*a* and 42*c*) where the forks contact the cam and the operating plate.

The embodiment of the invention shown in FIGS. 9(A) and 9(B) uses dual overhead camshafts. However, the forks can also be adapted for single overhead camshaft actuation, or by an underhead camshaft using pushrods to actuate the forks. FIG. 10 is a rough perspective view of some of the possible variations in the configuration of the operating forks. These alternatives would be selected by the engine designer to accommodate the overall configuration of the engine. FIG. 10(A) shows intake and exhaust forks that would be actuated by separate overhead camshafts. This double-overhead camshaft version is also shown in FIGS. 1 through 9. FIG. 10(B) shows an arrangement where the forks can be mounted on a common pivot shaft and operated by a single overhead camshaft. FIG. 10(C) shows a potential configuration for the forks where they would be operated by pushrods from a single camshaft that is located in the engine block.

EXPLANATION OF HOW INVENTION OPERATES

FIGS. 11(A) through 11(D) illustrate the operation of the ring valves (14, 16) during the four strokes of a gasoline engine. The view of the figures is identical to FIG. 1.

Figure 11A:
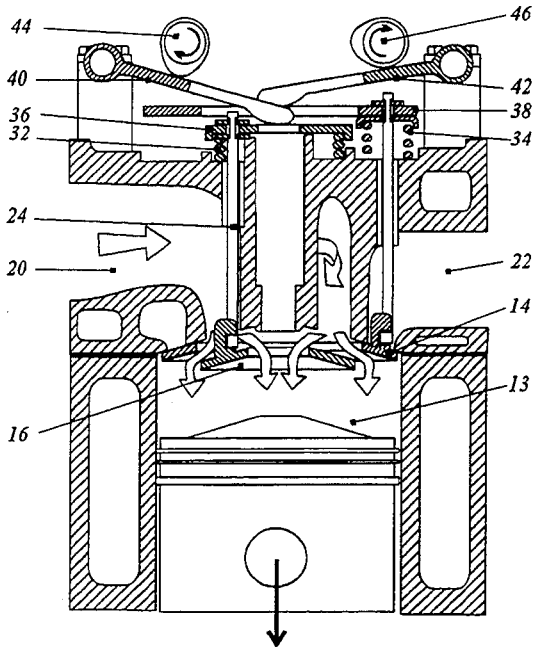

During the intake stroke, shown in FIG. 11(A), the intake cam (44) lobe presses downward on the intake operating fork (40). The fork presses down on the intake operating plate (36) at two points. The operating plate (36) and the three valve stems (24) move downward, forcing the intake ring valve (16) open. The fuel-air mixture is drawn into the intake port (20) from the engine's external induction system (carburetor, fuel injector, etc.). The intake fuel-air mixture enters the combustion chamber (13) from the annular intake port (20). The fuel-air mixture passes through the hole in the center of the intake ring valve (16) as well as around its periphery and is distributed more or less evenly throughout the combustion chamber (13). At the end of the intake stroke, the cam lobe (44) moves off of the intake fork (40) allowing the compressed operating spring (32) to shut the intake ring valve (16).

Figure 11B:
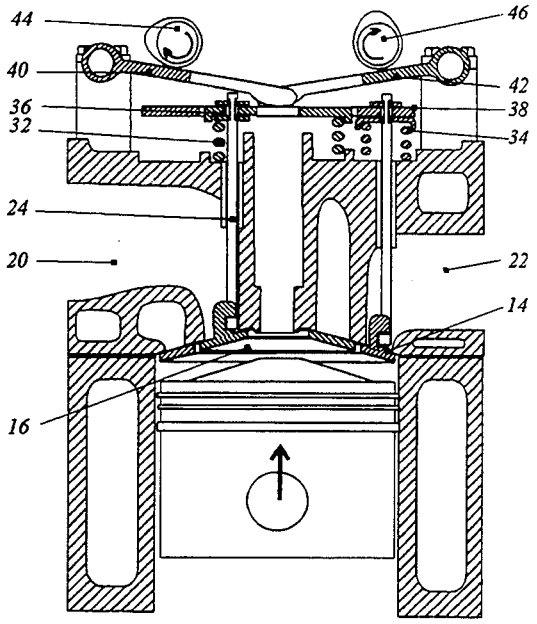
Figure 11C:
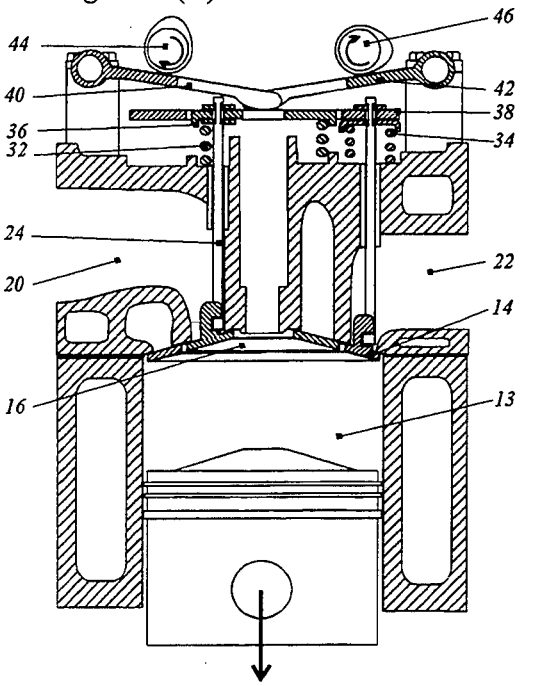

During the compression stroke (FIG. 11(B)) and the expansion stroke (FIG. 11(C)) the cams (44, 46) are positioned such that both ring valves (14, 16) remain shut.

Figure 11D:
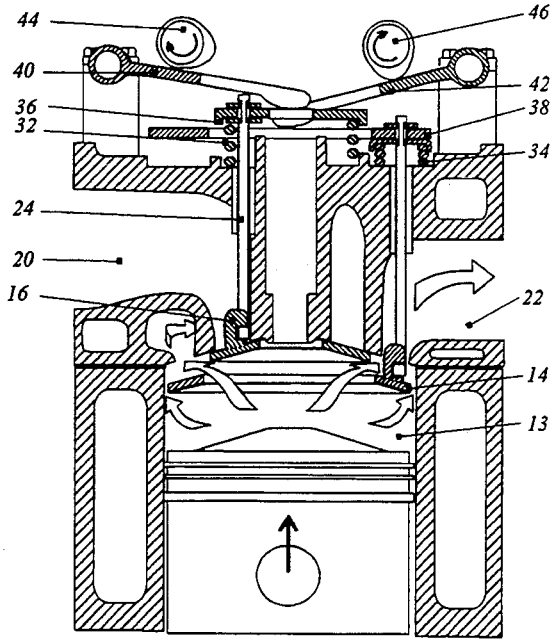

During the exhaust stroke (FIG. 11(D)), the exhaust cam lobe (46) forces the exhaust fork (42), exhaust operating plate (38), valve stems (26), and exhaust ring valve (14) into the open position. Combustion-product exhaust gasses leave the combustion chamber (13) primarily through the hole in the center of the exhaust ring valve (14), although a portion of the exhaust gasses pass around the ring valve's periphery. After exiting the combustion chamber (13), exhaust gasses enter the annular, concentric exhaust port (22) from which they are routed into the engine's external exhaust system. After the exhaust cam lobe (46) moves off of the exhaust fork (42), the exhaust ring valve (14) is shut by the three operating springs (34).

CONCLUSION

From the preceding, it can be seen that this invention overcomes many of the limitations of conventional popper valves. The entire area of the cylinder head can be put to a useful purpose, either for intake and exhaust or for the necessary spark plug (or central fuel injector for diesel engines). Because of geometric limitations, poppet valves must have wasted head space between them. This is not so with concentric ring valves. Poppet valves do not distribute the fuel-air mixture within the combustion chamber in a uniform manner. Concentric ring valves introduce the fuel-air mixture in a manner that is symmetrical throughout the combustion chamber. This contributes to uniform distribution of the mixture throughout the combustion chamber which should enhance complete combustion. This, in turn, will lead to more power, better fuel efficiency, and lower hydrocarbon emissions for an engine of given displacement. Additionally, no exotic materials or manufacturing methods are required.

Concentric ring valves and concentric, annular ports according to the invention can be adapted to any internal combustion engine that uses valves. A wide variety of configurations is available to meet the needs of individual engine designs. The configurations presented in this application are representative of only a few variants. The selection of one ring valve configuration over another is a function of engine design more than any other factor.

It should further be recognized that use in the above specification and in the following claims of terms of relative orientation, e.g., use of the terms "upper", "over", "upwardly" and the like, do not imply any limitation on the relative orientation of the engine of the invention in use, but are provided merely to make clear the relation of the components thereof. These terms are used with respect to the orientation of the engine shown in the Figures.

I claim:

1. An internal combustion engine, comprising:

a cylinder block, a rotating crankshaft, at least one piston connected to said crankshaft to reciprocate within a cylinder bore in said block responsive to rotation of said crankshaft, an improved cylinder head adapted to be affixed to said cylinder block and to define a combustion chamber in combination with said bore and said piston, said cylinder head defining intake and exhaust passages extending from intake means and exhaust means affixed to said cylinder head to first and second concentric annular intake and exhaust ports in communication with said combustion chamber, annular intake and exhaust valves, said valves being concentric with respect to one another and to said cylinder bore, and being mounted for reciprocation with respect to said cylinder head to open and close said intake and exhaust ports, and means for reciprocating said intake and exhaust valves with respect to rotation of said crankshaft.

2. The engine of claim 1, wherein said cylinder head further comprises annular intake and exhaust valve seat surfaces adapted to mate with sealing surfaces on said intake and exhaust valves.

3. The engine of claim 2, wherein said intake and exhaust valves comprise generally truncated conical members.

4. The engine of claim 3, wherein said annular mating sealing surfaces on said intake and exhaust valves are formed on upper surfaces of said valves urged by spring means into engagement with said annular intake and exhaust valve seat surfaces of said cylinder head in order to close said valves.

5. The engine of claim 1, wherein said cylinder head further comprises a central passageway which is concentric with said valve and extending from an externally accessible position to a port in communication with said combustion chamber.

6. The engine of claim 5, wherein said port in communication with said combustion chamber is adapted to receive a spark plug.

7. The engine of claim 5, wherein said port in communication with said combustion chamber is adapted to receive fuel injector means.

8. The engine of claim 1, wherein said means for reciprocating said intake and exhaust valves comprises a plurality of axially movable elongated valve stems, one end of each of said valve stems being affixed to the corresponding one of said valves, said valve stems extending from said valve in a direction generally away from said combustion chamber, and said valve stems being adapted to transfer axial force exerted on an opposed end of each of said valve stems to the corresponding valve, to open said valve.

9. The engine of claim 8, wherein said multiple elongated valve stems are affixed to said valves at one end of each of said valve stems by means permitting limited lateral movement of the ends of said valve stems with respect to said valves.

10. The engine of claim 8, wherein said means for reciprocating said intake and exhaust valves further comprises first and second axially movable operating plates for exerting axial force on said opposed ends of said valve stems, and actuator means for controlling the motion of said operating plates responsive to the rotation of said crankshaft.

11. The engine of claim 10, wherein said operating plates are of generally annular configuration and are centered over said cylinder bore, and said actuator means comprise bifurcated members adapted to exert force on said operating plates at two generally opposed positions, such that said operating plates open said valves by exerting axial force on said valve stems.

12. The engine of claim 10, further comprising intake and exhaust camshafts adapted for rotation responsive to rotation of said crankshaft and disposed such that when said camshafts are rotated, lobes on said camshafts urge said actuator means into engagement with said operating plates, such that said operating plates open said valves by exerting axial force on said valve stems.

13. The engine of claim 10, further comprising valve spring means adapted to urge said valve closed when axial force is removed from said valve stems.

14. The engine of claim 13, wherein said spring means are disposed between said operating plates and said cylinder head, and said operating plates are joined to said valve stems by means for transmitting axial force from said operating plates to said valve stems in both respective directions of motion of said valve stems.

* * * * *